US010219577B1

(12) United States Patent
Muller

(10) Patent No.: US 10,219,577 B1
(45) Date of Patent: Mar. 5, 2019

(54) INTEGRATED FIT AND RETENTION SYSTEM

(71) Applicant: Bell Sports, Inc., Scotts Valley, CA (US)

(72) Inventor: Hilgard N. Muller, Felton, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 18 days.

(21) Appl. No.: 15/702,631

(22) Filed: Sep. 12, 2017

Related U.S. Application Data

(63) Continuation of application No. 11/218,102, filed on Aug. 31, 2005, now Pat. No. 9,756,893.

(51) Int. Cl.
*A42B 3/14* (2006.01)
*A42B 3/08* (2006.01)

(52) U.S. Cl.
CPC ..... *A42B 3/142* (2013.01); *A42B 3/085* (2013.01)

(58) Field of Classification Search
CPC ..... A42B 3/142; A42B 3/085
See application file for complete search history.

(56) References Cited

U.S. PATENT DOCUMENTS 674,213 A 5/1901 Oldfield
1,213,800 A 1/1917 Piper
1,434,745 A 11/1922 MacLeod
2,270,149 A 1/1942 Gustavo
2,463,771 A 3/1949 Hunz
2,898,596 A * 8/1959 Keen ..... A63B 71/10 2/421
2,905,017 A 9/1959 Randolph
3,329,968 A 7/1967 Gordon
(Continued)

FOREIGN PATENT DOCUMENTS

EP 0 517 091 12/1992
JP 10-130939 8/1998
(Continued)

OTHER PUBLICATIONS

Notification of Transmittal of International Search Report, dated Oct. 17, 2005, regarding international Application No. PCT/US2005/253718.0-2314, 3 pages.
(Continued)

*Primary Examiner* — Andrew W Sutton
(74) *Attorney, Agent, or Firm* — Booth Udall Fuller, PLC

(57) ABSTRACT

In accordance with the teachings of the present invention, an integrated fit and retention system is provided. In a particular embodiment of the present invention, the integrated fit and retention system includes a first rigid strap and a second rigid strap, each having a first end and a second end. The first end of each rigid strap is coupled to a helmet body proximate a front of the helmet body, and the second end of each rigid strap is coupled to the helmet body proximate a rear of the helmet body. The integrated fit and retention system also includes a chin strap operable to couple the first and second rigid straps beneath a chin of a wearer. In particular embodiments, the integrated fit and retention system may further include a fit strap coupling the first and second rigid straps, that may be configured to sit below an occipital lobe of the wearer.

20 Claims, 4 Drawing Sheets

(56) References Cited

U.S. PATENT DOCUMENTS 3,480,966 A * 12/1969 Molitoris ..... A42B 3/08 2/421
3,500,474 A 3/1970 Austin
4,081,865 A 4/1978 Bergee et al. ..... 2/425
4,115,874 A 9/1978 Hasegawa ..... 2/425
4,651,356 A * 3/1987 Zide ..... A42B 3/08 2/421
4,888,831 A 12/1989 Oleson
5,007,141 A 4/1991 Gentes ..... 24/163 R
5,088,130 A 2/1992 Chiarella ..... 2/411
5,093,937 A 3/1992 Kamata ..... 2/424
5,093,938 A 3/1992 Kamata ..... 2/424
5,099,523 A 3/1992 Broersma ..... 2/411
5,119,516 A 6/1992 Broersma ..... 2/411
5,231,703 A 8/1993 Garneau ..... 2/414
5,269,025 A 12/1993 Broersma ..... 2/411
5,309,576 A 5/1994 Broersma ..... 2/412
5,351,341 A 10/1994 Broersma ..... 2/412
5,351,342 A 10/1994 Garneau ..... 2/414
5,357,654 A 10/1994 Hsing-Chi
5,469,583 A 11/1995 Akeley et al. ..... 2/421
5,477,563 A 12/1995 Gentes et al. ..... 2/411
5,481,762 A 1/1996 Gentes et al. ..... 2/411
5,551,094 A * 9/1996 Navone ..... A42B 3/08 2/418
5,571,220 A * 11/1996 Hall ..... A42B 3/08 2/421
5,608,917 A 3/1997 Landis
5,651,145 A 7/1997 Egger
5,659,900 A 8/1997 Arney et al. ..... 2/417
5,675,843 A 10/1997 Grim et al. ..... 2/422
5,729,877 A 3/1998 Kong et al. ..... 24/625
5,745,924 A 5/1998 Egger
5,774,901 A 7/1998 Minami ..... 2/421
5,794,272 A 8/1998 Workman et al.
5,833,796 A 11/1998 Matich ..... 156/285
5,867,840 A 2/1999 Hirosawa et al.
5,887,288 A 3/1999 Arney et al. ..... 2/421
5,896,586 A 4/1999 Freund
5,911,315 A * 6/1999 Flowers ..... A42B 3/08 2/421
5,915,537 A * 6/1999 Dallas ..... A42B 3/08 2/410
5,953,762 A * 9/1999 Corbett ..... A42B 3/0406 2/422
5,983,405 A 11/1999 Casale
6,009,561 A 1/2000 Bullock et al. ..... 2/422
6,009,562 A 1/2000 Bullock et al. ..... 2/422
6,105,176 A 8/2000 Egger
6,226,802 B1 * 5/2001 Sasaki ..... A42B 3/085 2/417
6,311,338 B1 * 11/2001 Galet ..... A42B 3/08 2/421
6,314,588 B1 11/2001 Fang
6,332,227 B1 12/2001 Fang
6,401,261 B1 6/2002 Arney et al. ..... 2/421
6,421,840 B1 7/2002 Chen et al. ..... 2/410
6,446,270 B1 9/2002 Durr ..... 2/412
6,449,776 B1 9/2002 Musal ..... 2/418
6,457,210 B1 10/2002 Shirai
6,481,019 B2 11/2002 Diaz
6,711,751 B1 3/2004 Muskovitz ..... 2/410
7,069,601 B1 7/2006 Jacobsen
7,111,329 B2 9/2006 Stroud et al.
7,203,972 B2 4/2007 Piertzak et al.
7,222,374 B2 5/2007 Musal et al.
2002/0083562 A1 * 7/2002 Lerra ..... A44B 11/266 24/115 G
2002/0124298 A1 9/2002 Muskovitz ..... 2/410
2004/0098793 A1 * 5/2004 Gershenson ..... A42B 3/08 2/425
2005/0262619 A1 12/2005 Musal et al.
2006/0248630 A1 11/2006 Bullock et al.
2007/0000022 A1 1/2007 Jacobsen
2007/0044210 A1 3/2007 Muller
2007/0277295 A1 12/2007 Bullock
2011/0302700 A1 * 12/2011 Vito ..... A42B 3/14 2/412

FOREIGN PATENT DOCUMENTS

WO WO 91/13560 9/1991
WO WO 2004/006706 1/2004

OTHER PUBLICATIONS

Pending U.S. Appl. No. 12/202,960, entitled Height-Adjustable Fit System, filed Sep. 2, 2008.

* cited by examiner

INTEGRATED FIT AND RETENTION SYSTEM

TECHNICAL FIELD OF THE INVENTION

The present invention relates generally to protective headgear and, more particularly, to an integrated fit and retention system.

BACKGROUND OF THE INVENTION

Protective headgear, such as helmets, are often used in activities, such as bicycling, skateboarding, motorcycling, rock climbing, snowboarding, and skiing, that are associated with an increased risk of head injury. Typically, such protective headgear is designed to maintain its structural integrity and stay secured to the head of a wearer, while protecting the wearer from a trauma to the head. This is often facilitated by a retention system that secures the headgear to the head of the wearer, and a fit system that tailors the fit of the helmet to the size and shape of the wearer's head. Each of these systems often have several different points of adjustment. These multiple points of adjustment, however, may make it difficult for an inexperienced wearer to properly adjust and wear the headgear.

SUMMARY OF THE INVENTION

In accordance with the teachings of the present invention, an integrated fit and retention system is provided. In a particular embodiment of the present invention, the integrated fit and retention system comprises a first rigid strap and a second rigid strap, each having a first end and a second end. The first end of each rigid strap is coupled to a helmet body proximate a front of the helmet body, and the second end of each rigid strap is coupled to the helmet body proximate a rear of the helmet body. The integrated fit and retention system also includes a chin strap operable to couple the first and second rigid straps beneath a chin of a wearer. In particular embodiments, the integrated fit and retention system may further comprise a fit strap coupling the first and second rigid straps, that may be configured to sit below an occipital lobe of the wearer.

A technical advantage of particular embodiments of the present invention may include an integrated fit and retention system having a reduced number of adjustment points, while still offering sufficient adjustability to properly fit a wearer.

Another technical advantage of particular embodiments of the present invention may include a helmet having rigid straps that encourage the correct placement of the helmet on the user's head. This helps reduce the possibility a user will incorrectly wear the helmet, inadequately protecting him or her from head injuries. Furthermore, the rigid straps extend from the helmet body when the helmet is held upside-down, preventing the straps from becoming tangled and easing the application of the helmet to the user's head.

Other technical advantages of the present invention may be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and features and advantages thereof, reference is now made to the following description, taken in conjunction with the accompanying drawings, in which.

DETAILED DESCRIPTION OF THE INVENTION

In accordance with the teachings of the present invention, an integrated fit and retention system and method are provided. For example, in a particular embodiment of the present invention, the integrated fit and retention system comprises first and second rigid straps, each having first and second ends. The first end of each rigid strap is coupled to a helmet body proximate the front of the helmet body, while the second end of each rigid strap is coupled to the helmet body proximate the rear of the helmet body. A chin strap may be used to couple the first and second rigid straps beneath the chin of the wearer. In particular embodiments, the integrated fit and retention system may further comprise a fit strap, which is typically elastic, that further couples the first and second rigid straps and is configured to sit below a wearer's occipital lobe when the helmet is worn. By having a minimal number of adjustments and by properly presenting rigid straps to a wearer, headgear in accordance with the teachings of the present invention lends itself to proper placement on the user's head, increasing the likelihood the user will correctly wear and adjust the headgear.

Figure 1:
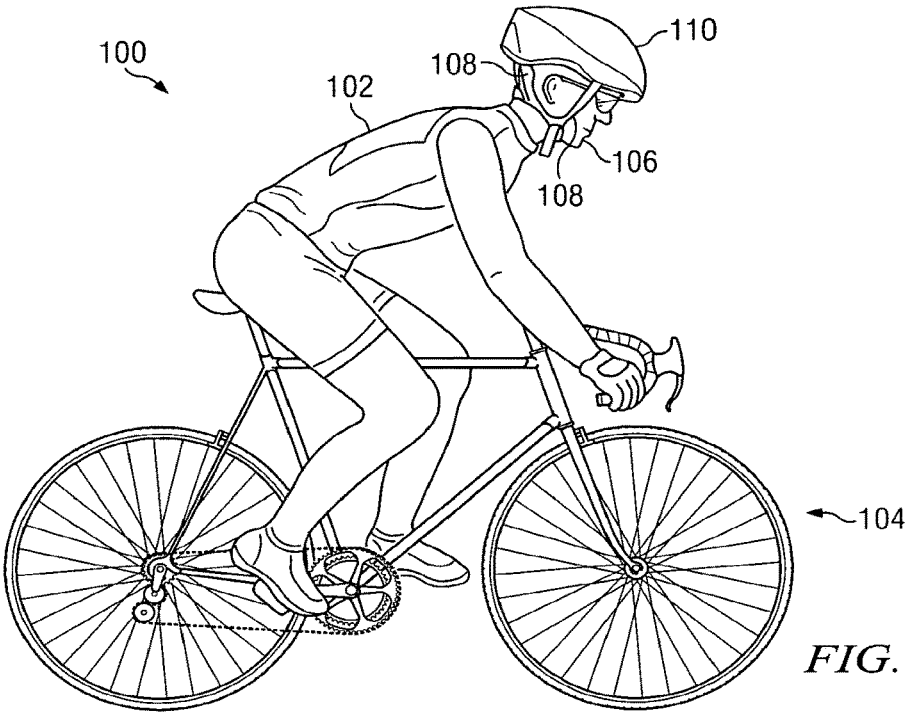
FIG. 1 illustrates an environment in which a helmet in accordance with a particular embodiment of the present invention may be used.

FIG. 1 illustrates one embodiment of an environment 100 in which a helmet 110 in accordance with a particular embodiment of the present invention may be used. As shown in FIG. 1, environment 100 includes a bicyclist (user) 102 riding a bicycle 104 and wearing helmet 110. In accordance with the teachings of the present invention, helmet 110 may be secured to head 106 of user 102 using integrated fit and retention system 108 which performs the dual functions of coupling helmet 110 to the user's head and allowing helmet 110 to be adjusted to properly fit the size and shape of the user's head.

As used herein, the term "helmet" refers to any type of protective headgear, such as a bicycle helmet, a motorcycle helmet, or a hardhat. Furthermore, although helmet 110 is used as an example to describe some embodiments of the present invention, any type of helmet, both protective and non-protective, may benefit from the teachings of the present invention.

If user 102 were to accidentally fall off bicycle 104, user 102 could suffer various injuries, including head trauma. Therefore, helmet 110 is designed to remain secured to head 106 during an impact and maintain its structural integrity to better protect head 106. As a secondary consideration, helmet 110 may also be designed to have an attractive appearance. For example, many users find a helmet with a sleek external appearance to be attractive. Such a sleek external appearance also facilitates the application of graphics to the external surface of the helmet.

Figure 2A:
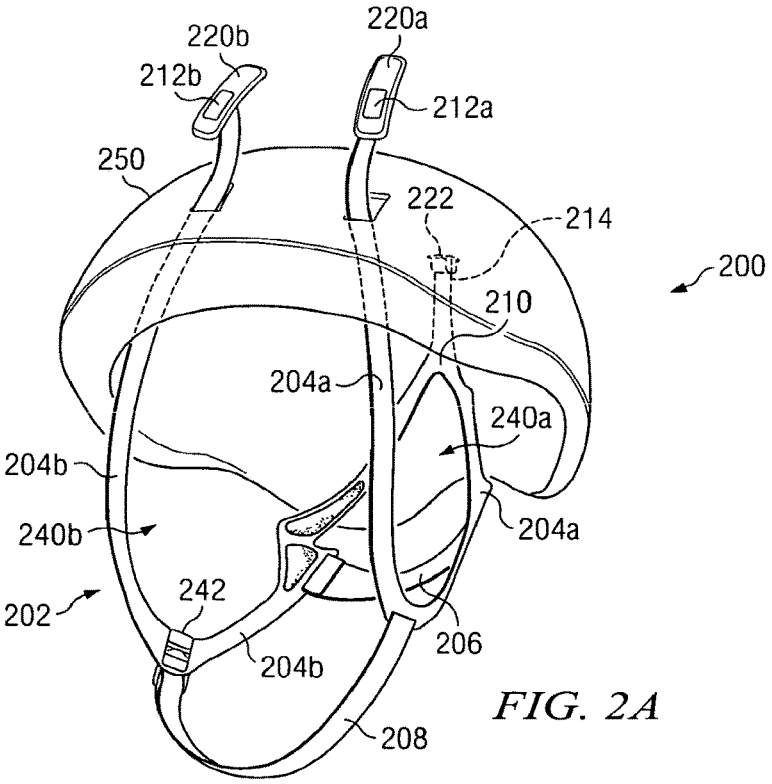
FIG. 2A illustrates a front perspective view of a helmet in accordance with a particular embodiment of the present invention.
Figure 2B:
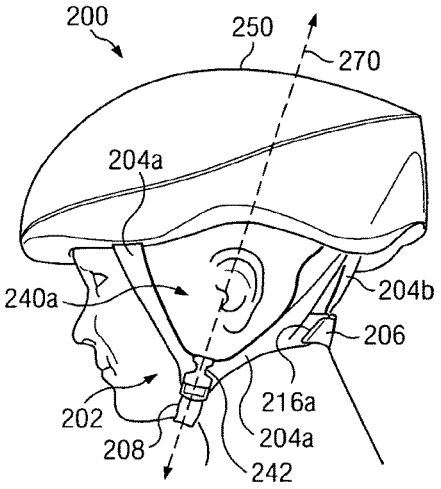
FIG. 2B illustrates a side view of the helmet shown in FIG. 2A.
Figure 2C:
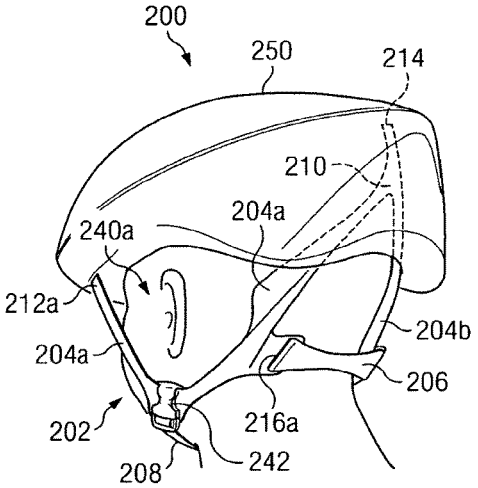
FIG. 2C illustrates a rear perspective view of the helmet shown in FIGS. 2A and 2B.

One such helmet is shown in FIGS. 2A-C, which illustrate different views of a helmet 200 in accordance with a particular embodiment of the present invention. FIGS. 2A and 2C illustrate front and rear perspective views, respectively, of helmet 200, while FIG. 2B illustrates a side view of helmet 200. Similar to helmet 110 in FIG. 1, helmet 200 in utilizes an integrated fit and retention system 202 to secure and fit helmet body 250 to the head of a user.

Generally, integrated fit and retention system 202 comprises a first rigid strap 204*a* and a second rigid strap 204*b* coupled to helmet body 250 of helmet 200. In particular embodiments, rigid straps 204 may comprise an elastomeric or plastic material. An example of one suitable elastomeric material is Hytrel® 7246, available from DuPont, although any suitable material may be used to form straps 204 in accordance with the teachings of the present invention.

Each rigid strap 204 has a first end 212 and a second end 214. First ends 212*a* and 212*b* of rigid straps 204*a* and 204*b*, respectively, are coupled to helmet body 250 proximate the front of the helmet body 250, while the second end 214 of rigid straps 204*a* and 204*b* are coupled to helmet body 250 proximate the rear of the helmet body 250. So coupled to helmet body 250, each rigid strap 204*a* forms a loop 240*a* on the left side of the user's head, while rigid strap 204*b* forms a loop 240*b* on the right side of the user's head. In particular embodiments of the present invention, loops 240 may take a variety of different shapes, selected to properly and comfortably secure helmet body 250 to the head of the wearer. In particular embodiments these may include partially circular, ellipsoid, triangular, or rhomboid shapes, among others. Generally, any shape that allows for the helmet to be secured to the head of the wearer while providing adequate protection during an impact may be used in accordance with the teachings of the present invention.

As shown in FIGS. 2A-C, in particular embodiments of the present invention, rigid straps 204*a* and 204*b* may share a common second end 214. In such an embodiments, rigid straps 204 may be coupled at an intersection 210, such that straps 204*a* and 204*b* share a common second end 214 that couples the straps to helmet body 250. In particular embodiments, this may help ease the manufacturing and assembly of the integrated fit and retention system 202. However, it should be understood that rigid straps 204 may have separate second ends 214 within the teachings of the present invention.

Integrated fit and retention system 202 also includes a fit strap 206 that couples first strap 204*a* and 204*b* behind the wearer's head. Generally, fit strap 206 comprises an adjustable strap that allows integrated fit and retention system 202 to accommodate a variety of head sizes and shapes. For example, in particular embodiments fit strap 206 comprises an elastic, or velcro-compatible elastic, strap. When helmet 200 is worn by a wearer, fit strap 206 may be configured to sit below the wearer's occipital lobe.

Fit strap 206 may be coupled with rigid straps 204*a* and 204*b* in a variety of different ways in accordance with the teachings of the present invention. For example, in particular embodiments of the present invention, fit strap 206 may be secured through a slot 216 in each rigid strap 204. In such an embodiment, each end of fit strap 206 may be looped through the corresponding slot 216, and sewn, or "bar-tacked," in place. In particular embodiments, this connection may be covered with a cosmetic cover (not illustrated) to further enhance the aesthetic appeal of helmet 200.

As shown in FIGS. 2A-C, integrated fit and retention system 202 also includes a chin strap 208 operable to couple rigid straps 204*a* and 204*b* beneath the chin of the wearer. In particular embodiments, chin strap 208 is adjustable and comprises nylon webbing or another suitable material. In particular embodiments of the present invention, one end of chin strap 208 may be secured through a slot 218 (FIG. 3) in rigid strap 204*b*. In particular embodiments, this is done by passing the end of chin strap 208 through slot 218 and then sewing, or "bar-tacking," the end of strap 208 back onto itself such that a loop is formed, securing strap 208 through slot 218. The other end of chin strap 208 may then be attached to rigid strap 204*a* using a buckle 242. In such an embodiment, one portion of buckle 242 may be attached to the loose end of chin strap 208. The other portion of buckle 242 may be attached to rigid strap 204*a*. When the two portions of buckle 242 are coupled, chin strap 208 may be used couple rigid straps 204*a* and 204*b* beneath the user's chin, properly securing the helmet 200 to the user's head.

In particular embodiments of the present invention, buckle 242 and slot 218 are configured such that chin strap 208 (when coupling rigid straps 204*a* and 204*b*) is positioned in, or near, an optimum location for securing the helmet under the user's chin. This optimum location is illustrated in FIG. 2B by imaginary line 270, which passes through the user's ear and the base of the user's jaw. In order to position strap 208 in this optimum location, buckle 242 and slot 218 (FIG. 3) are positioned on rigid straps 204*a* and 204*b*, respectively, so that buckle 242 and slot 218 also fall along line 270 which positioned on a user's head. With buckle 242 and slot 218 so positioned, chin strap 208 then falls along imaginary line 270, as well, when used to couple rigid straps 204*a* and 204*b* together under the user's chin.

As an additional safety feature, particular embodiments of the present invention may also include a "pinch guard" feature to prevent the user's skin from being caught in buckle 242. In such an embodiment, rigid strap 204*a* includes a lip 272 (FIG. 3) that extends beyond the opening of the portion of buckle 242 attached to the strap. This lip 272 is configured to lay against the user's face, between the user's face buckle 242. So positioned, lip 272 prevents the skin of the user's face from being caught in buckle 242 when the male and female portions of the buckle are coupled together.

Figure 3:
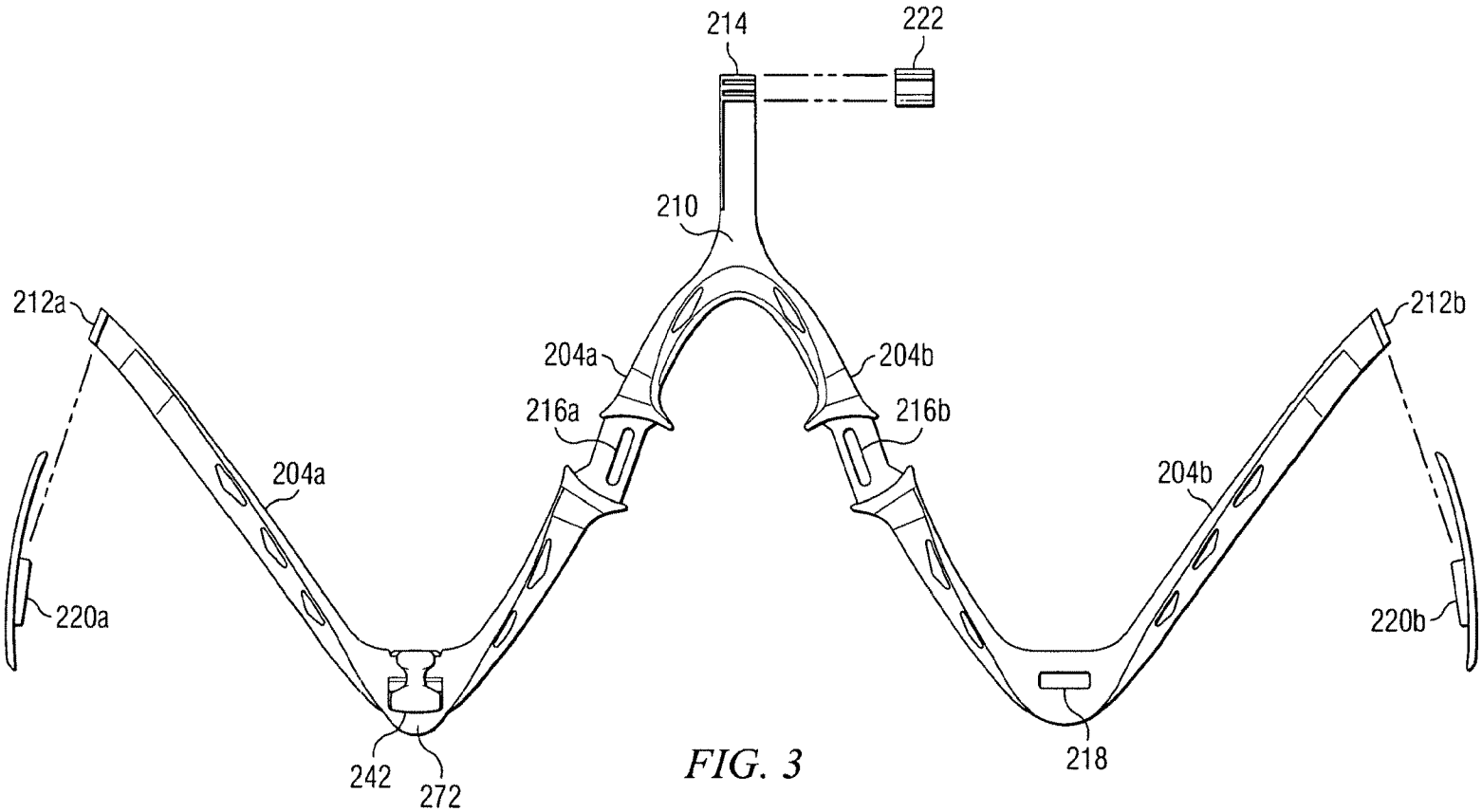
FIG. 3 illustrates a rigid strap system in accordance with a particular embodiment of the present invention.

FIG. 3 illustrates rigid straps 204*a* and 204*b* uncoupled from helmet body 250, fit strap 206, and chin strap 208. As shown in FIG. 3, rigid straps 204*a* and 204*b* are depicted laying flat, so that straps 204*a* and 204*b* are in the same plane (as they may be manufactured). However, it should be understood that when rigid straps 204*a* and 204*b* are coupled with a helmet body 250, the straps 204 are positioned so that they wrap around a wearer's head, as shown in FIGS. 2B and 2C.

As discussed above, rigid straps 204*a* and 204*b* include first ends 212*a* and 212*b*, respectively, and a second end 214. Typically, each strap 204 has a generally triangular or partial ellipsoidal shape, such that the strap forms the desired shape loop 240 (FIGS. 2A-C) when coupled to helmet body 250 (FIGS. 2A-C). At the bottom of this triangular or partial ellipsoidal shape is a slot 218 configured to receive chin strap 208 (FIGS. 2A-C). Intermediate slot 218 and second end 214, each rigid strap 204 includes a slot 216 configured to receive fit strap 206 (FIGS. 2A-C).

First ends 212*a* and 212*b* are configured to be coupled with front hangers 220*a* and 220*b*, respectively, while second end 214 is configured to be coupled with rear hanger 222. Front hangers 220 and rear hanger 222, which are configured to couple the ends of rigid straps 204 to helmet body 250 (FIGS. 2A-C), are further illustrated in FIGS. 4A-C and 5A-C, respectively.

Figure 4A:
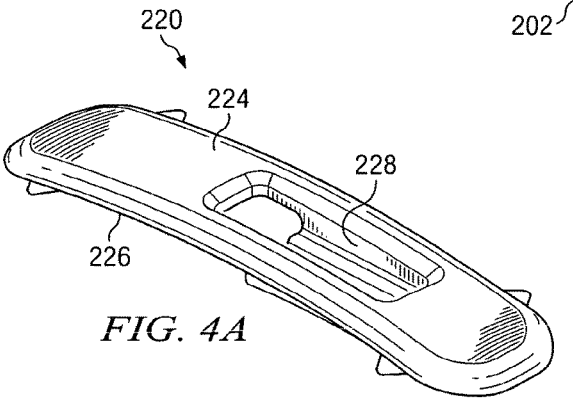
FIG. 4A illustrates an perspective view of the upper surface of a front hanger in accordance with a particular embodiment of the present invention.
Figure 4B:
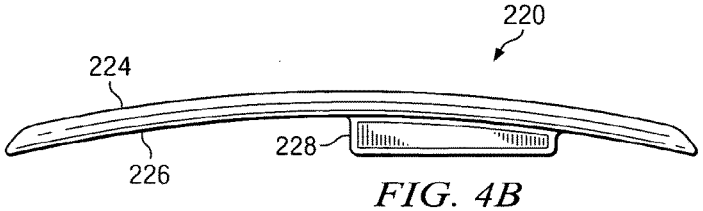
FIG. 4B illustrates a side view of the front hanger shown in FIG. 4A.
Figure 4C:
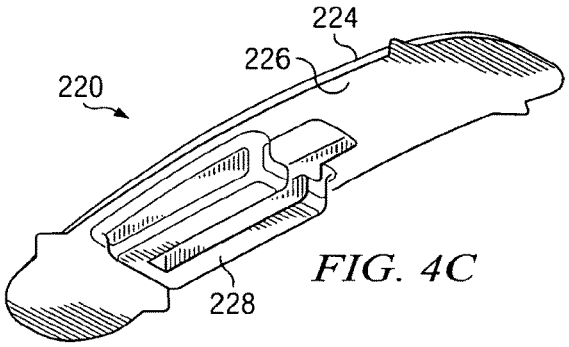
FIG. 4C illustrates a perspective view of the lower surface of the front hanger shown in FIGS. 4A and 4B.

FIGS. 4A-C illustrate different views of front hanger 220 in accordance with a particular embodiment of the present invention. FIGS. 4A and 4C illustrate perspective views of the upper and lower surfaces, respectively, of front hanger 220, while FIG. 4B illustrates a side view of front hanger 220. Although FIGS. 4A-C illustrate particular hanger configurations in accordance with the teachings of the present, it should be understood that these are offered as examples only. Any suitable technique may be used to couple rigid straps 204 to helmet body 250.

Generally, front hanger 220 comprises an upper surface 224 and a lower surface 226. Extending below lower surface 226 of front hanger 220 is recessed portion 228, which is configured to receive the first end 212 (FIG. 3) of rigid strap 204 (FIG. 3). In particular embodiments, upper surface 224 may be curved to match or compliment the curvature of helmet body 250 (FIGS. 2A-C). Typically, first end 212 of strap 204 may be inserted through a hole (not illustrated) in helmet body 250 where first end 212 is coupled with front hanger 220 on the exterior of helmet body 250. So coupled to front hanger 220, end 212 may not be pulled back through the hole in helmet body 250. In particular embodiments, front hanger 220 may further couple end 212 to helmet body 250 by being coupled to helmet body 250 itself. This may help to further secure rigid straps 204 to helmet body 250.

Figure 5A:
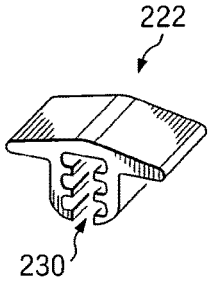
FIG. 5A illustrates a perspective view of a rear hanger in accordance with a particular embodiment of the present invention.
Figure 5B:
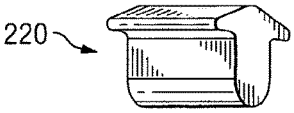
FIG. 5B illustrates a side perspective view of the rear hanger shown in FIG. 5A.
Figure 5C:
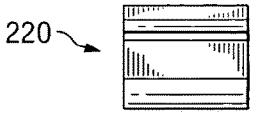
FIG. 5C illustrates a side view of the rear hanger shown in FIGS. 5A and 5B.

Similar to front hanger 220, rear hanger 222 helps to secure the second end 214 of rigid straps 204 to helmet body 250. FIGS. 5A-C better illustrate rear hanger 222 in accordance with a particular embodiment of the present invention. FIG. 5A illustrates a perspective view of rear hanger 222, FIG. 5B illustrates a side perspective view of rear hanger 222, and FIG. 5C illustrates a side view of rear hanger 222.

As shown in FIGS. 5A-C, rear hanger 222 generally comprises a T-shaped connecter, also referred to as an "E-nut." In particular embodiments of the present invention, rear hanger 222 includes a recessed portion 230 configured to receive second end 222 (FIG. 3) of rigid straps 204*a* and 204*b* using a series of matching tongues and grooves on both end 222 and in recessed portion 230. Similar to the coupling of front hanger 220 and first end 212, rear hanger 222 is designed to be coupled with second end 214 on the exterior of helmet body 250. Typically, second end 214 is passed from the interior of helmet body 250 to the exterior of body 250 through a hole in body 250. On the exterior side of helmet body 250, second end 214 is then coupled with rear hanger 222 by sliding second end 214 into recessed portion 230 of rear hanger 222. Second end 214 and rear hanger 222 are then pulled back toward helmet body 250 so that rear hanger 222 engages helmet body 250, securing second end 214 of rigid straps 204 to helmet body 250.

Figure 6:
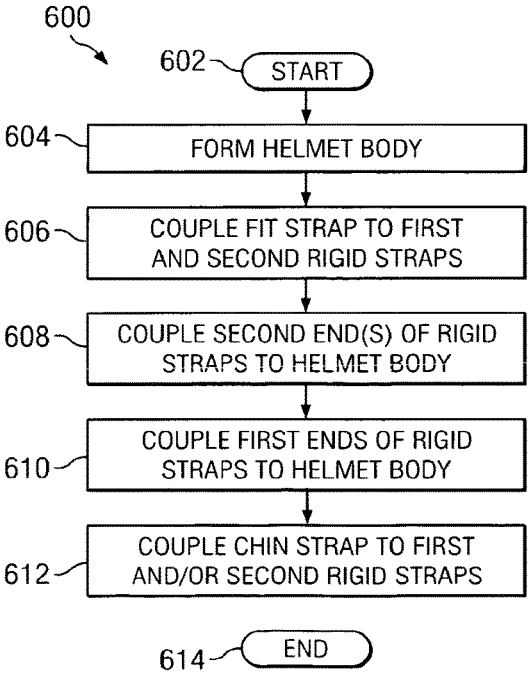
FIG. 6 is a flowchart illustrating a method of assembling an integrated fit and retention system in accordance with a particular embodiment of the present invention.

A better understanding of the system and method of the present invention may be had by referring to FIG. 6, which illustrates a flowchart 600 of a method of assembling a integrated fit and retention system in accordance with a particular embodiment of the present invention.

After flowchart 600 begins in block 602, a helmet body is formed in block 604. A fit strap is then coupled to the first and second rigid straps in block 606. Typically, this is accomplished by coupling each end of the fit strap to first and second rigid straps. In particular embodiments of the present invention, each end of the fit strap is looped through a slot in its respective rigid strap and then sewn, or "bar-tacked" back on itself. In particular embodiments, this connection may then be covered and/or protected by a cosmetic cover.

Once the fit strap is coupled with the rigid straps in block 606, the second end(s) of the rigid straps is coupled to the helmet body proximate the rear of the helmet in block 608. In particular embodiments of the present invention, the first and second rigid straps may share a common second end, as shown in FIG. 3. However, the first and second rigid straps may have individual second ends and still fall within the teachings of the present invention. A number of methods for attaching the second end(s) of the rigid straps are available within the teachings of the present invention. In particular embodiments, the second end(s) may be coupled to the helmet body using an "E-nut," as described above with regard to FIGS. 3 and 5A-C.

The first ends of the rigid straps are then coupled with the helmet body proximate the front of the helmet in block 610. In particular embodiments of the present invention, the first end of each rigid strap is passed through a hole in the interior of the helmet body and coupled with a front hanger, as described above with regard to FIGS. 3 and 4A-B. So coupled, the front hanger prevents the first ends of the rigid straps from being inadvertently decoupled from the helmet body.

A chin strap operable to couple the rigid straps together under the chin of a wearer is then coupled with the first and/or second rigid strap in block 612. In particular embodiments, this chin strap comprises a piece of nylon webbing that buckles adjacent to one of the rigid straps. Typically, this chin strap is secured through a slot in each of the rigid straps. After the chin strap is coupled with the rigid straps, the flowchart terminates in block 614.

Although flowchart 600 describes a particular order of steps for assembling a integrated fit and retention system in accordance with a particular embodiment of the present invention, particular embodiments of the present invention may use all, some, or none of the steps described above. Moreover, particular embodiments may perform those steps in a different order than that described above without departing from the teachings of the present invention.

By coupling such an integrated fit and retention system with a helmet or other piece of protective headgear, particular embodiments of the present invention may offer numerous advantages. For example, particular embodiments of the present invention include a reduced number of adjustment points, making it easier to properly adjust the integrated fit and retention system to a wearer's head. Particular embodiments of the present invention also include rigid straps that present themselves erect from the helmet body, helping to prevent the straps from becoming tangled and possibly worn incorrectly by an inexperienced wearer.

Although particular embodiments of the method and apparatus of the present invention have been illustrated in the accompanying drawings and described in the foregoing detailed description, it will be understood that the invention is not limited to the embodiments disclosed, but is capable of numerous rearrangements, modifications, and substitutions without departing from the spirit of the invention as set forth and defined by the following claims.

What is claimed is:

1. A helmet comprising:

a helmet body comprising an interior and an exterior opposite the interior;

a first front hanger and a second front hanger coupled to the helmet body through an interior surface of the helmet body;

at least one rear hanger coupled to the helmet body through the interior surface of the helmet body;

a first end of a first strap coupled to the first front hangar proximate a front of the helmet body and a first end of a second strap coupled to the second front hanger proximate the front end of the helmet body;

a second end of the first strap coupled to the at least one rear hanger proximate a rear of the helmet body and a second end of the second strap coupled to the at least one rear hanger proximate the rear of the helmet body;

wherein the first and second strap each form a shaped loop below respective first and second sides of the helmet body;

an elastic fit strap coupled between the first strap and the second strap below a lower edge of the helmet body proximate the rear of the helmet body such that the elastic fit strap sits below an occipital lobe of a wearer of the helmet when the helmet is worn by the wearer;

wherein the first and second straps are formed of a material more rigid than the elastic fit strap; and a chin strap coupled to at least the first strap.

2. The helmet of claim 1, wherein the first and second hangers are disposed on the exterior of the helmet body.

3. The helmet of claim 2, wherein the at least one rear hanger is disposed on the exterior of the helmet body.

4. The helmet of claim 1, wherein each end of the elastic fit strap is looped through a corresponding slot in the respective first strap and second strap and attached back to a body of the elastic fit strap.

5. The helmet of claim 4, wherein the slot formed through the first rigid strap intersects with an imaginary line that would pass through the wearer's ear and a base of the wearer's jaw when the helmet is worn by the wearer.

6. The helmet of claim 1, wherein the first and second straps comprise an elastomeric material.

7. The helmet of claim 1, wherein the first and second straps comprise a plastic material.

8. The helmet of claim 1, wherein a first length of the first strap measured between the at least one rear hanger and an end of the chin strap is a fixed, non-adjustable length.

9. A helmet comprising:

a helmet body comprising an interior and an exterior opposite the interior;

a hanger coupled to the helmet body through an interior surface of the helmet body;

a rigid strap coupled to the hanger and extending as a single strap to the interior surface of the helmet body, the rigid strap dividing within the interior of the helmet body from the single strap to a first rigid strap and a second rigid strap, the first rigid strap and the second rigid strap separately extending across a bottom edge of the helmet body;

a fit strap coupled between the first rigid strap and the second rigid strap, wherein the first rigid strap and the second rigid strap are formed of a material more rigid than the fit strap; and a chin strap coupled to the first rigid strap.

10. The helmet of claim 9, wherein the fit strap is coupled to the first rigid strap and the second rigid strap below a lower edge of the helmet body.

11. The helmet of claim 9, wherein each end of the fit strap is looped through a corresponding slot in the respective first rigid strap and second rigid strap and attached back to a body of the elastic fit strap.

12. The helmet of claim 11, wherein the slot formed through the first rigid strap intersects with an imaginary line that would pass through a wearer's ear and a base of the wearer's jaw when the helmet is worn by the wearer.

13. The helmet of claim 9, wherein the rigid strap comprises a plastic material.

14. The helmet of claim 9, wherein the rigid strap comprises an elastomeric material.

15. The helmet of claim 9, wherein the first rigid strap and the second rigid strap further separately extending through respective first and second front holes in the helmet body from the interior to the exterior of the helmet body and are separately coupled to a respective first front hanger and second front hanger.

16. The helmet of claim 9, wherein the fit strap comprises an elastic material.

17. The helmet of claim 9, wherein the fit strap comprises a hook and loop fastener material.

18. A helmet comprising:

a helmet body comprising an interior and an exterior opposite the interior, and a rear of the helmet body;

a first front hanger and a second front hanger coupled to the helmet body through an interior surface of the helmet body;

at least one rear hanger coupled to the helmet body through the interior surface of the helmet body;

a first strap coupled from the first front hanger to the at least one rear hanger;

a second strap coupled from the second front hanger to the at least one rear hanger;

an elastic fit strap coupled to the first strap and the second strap below a lower edge of the helmet body proximate the rear of the helmet body such that the elastic fit strap is positioned below an occipital lobe of a wearer of the helmet when the helmet is worn by the wearer, wherein the first strap and the second strap are formed of a material more rigid than the elastic fit strap; and a chin strap coupled to at least the first strap.

19. The helmet of claim 18, wherein each end of the elastic fit strap is looped through a corresponding slot in the respective first strap and second strap and attached back to a body of the elastic fit strap.

20. The helmet of claim 18, wherein the first and second straps comprise a plastic material.

* * * * *